US007811950B2

(12) United States Patent
Greiser et al.

(10) Patent No.: US 7,811,950 B2
(45) Date of Patent: Oct. 12, 2010

(54) DIMENSIONALLY STABLE PLY SUITABLE FOR ROOFING WEBS OR ROOF-SEALING WEBS

(75) Inventors: Wolfgang Greiser, Neusäβ (DE); Roger Souther, Woodruff, SC (US); Bertrand Weiter, Bobingen (DE)

(73) Assignee: Johns Manville, Denver, CO (US)

( * ) Notice: Subject to any disclaimer, the term of this patent is extended or adjusted under 35 U.S.C. 154(b) by 893 days.

(21) Appl. No.: 10/577,889

(22) PCT Filed: Oct. 25, 2004

(86) PCT No.: PCT/IB2004/003515

§ 371 (c)(1),
(2), (4) Date: Mar. 2, 2007

(87) PCT Pub. No.: WO2005/042823

PCT Pub. Date: May 12, 2005

(65) Prior Publication Data

US 2007/0190875 A1 Aug. 16, 2007

Related U.S. Application Data

(60) Provisional application No. 60/516,593, filed on Oct. 31, 2003.

(30) Foreign Application Priority Data

Feb. 18, 2004 (EP) ..... 04003571

(51) Int. Cl.
*B32B 27/04* (2006.01)
*B32B 27/12* (2006.01)

(52) U.S. Cl. ..... 442/85; 442/401; 442/402; 442/408; 264/288.4; 264/289.6; 264/479

(58) Field of Classification Search ..... 442/401, 442/402, 408, 85; 264/479, 288.4, 289.6
See application file for complete search history.

(56) References Cited

U.S. PATENT DOCUMENTS

| | | | | |
|---|---|---|---|---|
| 4,429,002 | A * | 1/1984 | Fukada et al. | 442/334 |
| 5,118,550 | A * | 6/1992 | Baravian et al. | 428/90 |
| 6,110,846 | A * | 8/2000 | Brzozowski et al. | 442/85 |
| 6,436,510 | B1 * | 8/2002 | Heidel et al. | 428/142 |
| 6,533,987 | B2 * | 3/2003 | Topolkaraev et al. | 264/442 |

* cited by examiner

*Primary Examiner*—Norca L Torres-Velazquez
(74) *Attorney, Agent, or Firm*—Robert D. Touslee

(57) ABSTRACT

A polyester filament nonwoven ply is suitable for roofing and roof-sealing webs and has a latent shrinkage force which counteracts drafting forces which may subsequently occur as the result of stresses or during thermal processing operations. The roofing webs thus remain dimensionally stable even when exposed to heat. The shrinkage force is obtained according to the claimed process by drafting the ply accordingly in a drafting mechanism arranged after a dryer.

13 Claims, No Drawings

DIMENSIONALLY STABLE PLY SUITABLE FOR ROOFING WEBS OR ROOF-SEALING WEBS

RELATED APPLICATIONS

This application is the U.S. National State of International Application No. PCT/IB2004/003515, filed Oct. 25, 2004, published in German, and claims priority under 35 U.S.C. §119 or 365 to U.S. Provisional Application No. 60/516,593, filed Oct. 31, 2003 and European Application No. 04 003 571.9, filed on Feb. 18, 2004.

The invention relates to a core based on a polyester non-woven, which core can be processed, either alone or in combination with other fabrics, to form a bituminised roofing membrane or sealing membrane, to a method for the production thereof, and to intermediate products or end products produced therefrom, namely composite materials and bituminised roofing membranes and sealing membranes.

Cores for bituminised roofing membranes or sealing membranes generally comprise a textile fabric, such for example as a bonded non-woven formed from synthetic fibres, which is usually combined with one or more layers of other, or even the same, fabrics.

These cores are bituminised, and are often provided on one side with slate flakes or with a film or foil. The end product which is obtained in this way, i.e. the roofing membrane or even the sealing membrane, is often of a considerable intrinsic weight, which is frequently of the order of 2.5 to 6 kilos/$m^2$.

During the further processing, which often takes place at temperature of up to approximately 200° C., a wide variety of forces act on the cores, such for example as tensile forces when the core is passed though a bath of bitumen and is withdrawn from the bath again. The core becomes longer when this happens.

Forces which act on the membrane also occur if it is able to sag under its own weight, e.g. when it is being conveyed from one piece of equipment to the next. In this case too a lengthening takes place. These forces, and other forces too, thus cause a deformation, i.e. a straining, of the core, and a latent stress builds up in the core and, when there is next a stage of treatment in which heating takes place in an unstressed or only lightly stressed state, this latent stress is released and causes the core to shrink.

This is particularly disadvantageous if, when it is being laid for example, the roofing membrane is operated on with heat. The membrane recovers to a greater or lesser degree from the strain, shrinks and, as it does so, pulls together. It is however also possible that the membrane will begin to shrink when it has already been laid, e.g. as a result of irradiation by sunlight and the increase in temperature which this involves. When this happens, unnevennesses and undulations form. And if the membranes have been laid with no overlap or insufficient overlap, leaks occur, because exposed points at which moisture, dust and the like can enter may be created in the roof covering as result of the shrinkage.

Even if the overlap was, in itself, of an adequate size and the shrinkage therefore does not produce any exposed points, problems may also arise because, under shrinkage, the membrane, as it pulls back, removes, as it were pulls off, the slate flake covering from the points situated beneath this covering. What this means is that the points which have been bared of slate flakes are exposed unprotected to the elements, as a result of which premature or fast ageing takes place, which causes premature embrittlement and which again produces points at which dust and in particular moisture are able to enter.

It is true that attempts have been made to improve the dimensional stability of the cores and also of the bituminised roofing or sealing membranes by reinforcing the cores with filaments, scrims, woven meshes and the like, in particular by embedding glass scrims or longitudinal filaments of glass. Fabrics of this kind are described in EP 0 572 891 B1 for example.

However, these provisions complicate the manufacture of the cores because there are one or more further steps in the process. In addition, the reinforcements have to be manufactured separately, often by complicated and expensive processing steps. In many cases, dimensional stability cannot be guaranteed in an entirely satisfactory way even by the incorporation of reinforcements.

In this way, it may for example happen that, when the reinforcement is by glass filaments, individual filaments may fail or filaments may break and points may thus be produced which are not reinforced or not so well reinforced, which means that undulations may occur at these points if any tensile stress is applied.

With processes of this kind, the danger exists that only with difficulty can products of good, consistent quality be produced repeatably for any length of time and there is often material which has to be scrapped.

For this reason, reinforced cores not only have a whole range of technical disadvantages but are also complicated and more expensive to produce. There is thus still a requirement for improved cores which are suitable in particular for bituminised roofing or sealing membranes, and for improved methods of producing them, which cores and methods do not have the disadvantages mentioned above or have them to only a reduced extent.

It is therefore an object of the invention to provide a core which does not have the above-mentioned disadvantages and which is suitable in particular for the production of roofing and sealing membranes, which is free of reinforcements, which is easy and economical to produce and which gives end products which are of high thermal dimensional stability.

This object is achieved by a core which is suitable as a core for roofing and sealing membranes, comprising a reinforcement-free, bonded non-woven of polyester filaments which is bound by a binder and which has a latent shrinkage force which counteracts the strains which arise in those subsequent treatment operations in the course of the manufacture of composite materials which take place under heat.

The non-woven is preferably bonded mechanically by means of needles.

What are also very suitable are non-wovens which are bonded hydrodynamically or thermally.

The shrinkage force is preferably equal to the sum of the strains. An advantageous range for the shrinkage force is 2 N/5 cm to 20 N/5 cm, and in particular 6 N/5 cm to 10 N/5 cm. If required, the shrinkage force may however also be of higher or lower values.

The non-woven is preferably a non-woven of polyethylene terephthalate filaments.

The invention also relates to a method of producing a reinforcement-free non-woven core of polyester filaments which is suitable as a core for roofing and sealing membranes, which method is characterised in that a non-woven of polyester filaments is produced by the spun-bond process, the non-woven obtained in this way is bonded, is provided with a binder, is dried in a dryer and is stretched on a stretching unit positioned downstream of the dryer to an extent such that the non-woven has a shrinkage force which counteracts the strains which arise in the subsequent treatment operations which take place under heat.

The shrinkage force is preferably equal to the strains. An advantageous range for the shrinkage force is 2 N/5 cm to 20 N/5 cm, and in particular 6 N/5 cm to 10 N/5 cm.

A non-woven of polyethylene terephthalate filaments is preferably used.

It is advantageous for the non-woven to be needle-punched more than once, and in particular two or three times.

The needle-punched non-woven may also be bonded on a calender having an embossing calender and in particular having heated calenders. The invention also relates to composite materials, roofing membranes and sealing membranes which contain cores as described above.

The weight per unit area of the non-woven is within the usual range and can be varied to suit the purpose for which it is used. Standard binders are used for binding the non-woven, preferably in the form of 5-25% aqueous dispersions.

Having been provided with the binder, the non-woven is then dried. Positioned directly downstream of the drying operation is a stretching unit on which the non-woven is stretched, this being done at a temperature which is above the crystallisation temperature of the polyester used. The temperature of the non-woven is thus not intended to drop below this temperature before the shrinkage force has built up, and this temperature is preferably 130°-140° C.

The extent of the stretching on the stretching unit depends on the desired latent shrinkage force which it is intended will build up. This force can be individually set to suit the customer's wishes.

The stretching according to the invention on the stretching unit endows the non-woven with a shrinkage force which remains latent in the non-woven and which is released again when the non-woven core is stressed by heat in further processing operations. This shrinkage force then counteracts the strains and entirely, or at least largely, cancels them out. Strains of this kind are produced if for example the non-woven is drawn through a bath of hot bitumen or if the still hot bituminised non-woven has an opportunity to sag as it is fed onwards. Its own weight then causes a strain.

Roofing membranes may for example be laid by fastening them in place mechanically in the cold state. However, what is also of importance is laying by the welding process.

Because the invention makes available non-shrink roofing membranes provided with a core, shrinkage does not occur even when there is irradiation by sunlight and when the heating-up which this involves occurs, which means that the disadvantages described above do not occur and there are thus no exposed points produced between the runs and no points at which the slate flake overlay is removed.

What is meant by composite materials in the context of the invention is multi-layered textile and industrial fabrics, fabrics of this kind having a coating, roofing and sealing membranes, floor coverings, e.g. ones having a coating of PVC, and also bituminised roofing and sealing membranes and the like.

The size of the shrinkage forces with which the non-woven is to be endowed in accordance with the invention can easily be determined by a few preliminary tests; it is found from the sum of the strains which act on the core until the time when the finished end product has been produced. It is possible in this way for a product which is tailored to the wishes of the end-customer to be produced.

The cores according to the invention can be produced easily and economically. Because of the absence of reinforcements such in particular as glass filaments, woven glass meshes or glass scrims, they are particularly inexpensive.

The invention claimed is:

1. A core for roofing and sealing membranes, comprising a reinforcement-free, bonded non-woven of polyester filaments which is bound by a binder and which has a latent shrinkage force of 2 N/5 cm to 20 N/5 cm.

2. The core according to claim 1, characterised in that the non-woven is bonded mechanically by means of needles.

3. The core according to claim 1, characterised in that the non-woven is bonded hydrodynamically.

4. The core according to claim 1, characterised in that the nonwoven is bonded thermally.

5. The core according to claim 1, characterised in that the shrinkage force is 6 N/5 cm to 10 N/5 cm.

6. The core according to claim 1, characterised in that the non-woven is a non-woven of polyethylene terephthalate filaments.

7. A method of producing a reinforcement-free non-woven core of polyester filaments which is suitable as a core for roofing and sealing membranes, characterised in that a non-woven of polyester filaments is produced by the spun-bond process, the non-woven obtained in this way is bonded, is provided with a binder, is dried in a dryer and is stretched on a stretching unit positioned downstream of a dryer at a temperature above the crystallization temperature of the polyester to an extent such that the non-woven has a shrinkage force in a range from 2 N/5 cm to 20 N/5 cm.

8. Method according to claim 7, characterised in that shrinkage force is in a range from 6 N/5 cm to 10 N/5 cm.

9. Method according to claim 7, characterised in that the non-woven of polyester filaments is a non-woven of polyethylene terephthalate.

10. Method according to claim 7, characterised in that for bonding the non-woven is needle-punched and passed through a calender.

11. A composite material comprising a core for roofing and sealing membranes, wherein the core comprises a reinforcement-free, bonded non-woven of polyester filaments which is bound by a binder and which has a latent shrinkage force of 2 N/5 cm to 20 N/5 cm.

12. A roofing or sealing membrane comprising a core for roofing and sealing membranes. wherein the core comprises a reinforcement-free. bonded non-woven of polyester filaments which is bound by a binder and which has a latent shrinkage force of 2 N/5 cm to 20 N/5 cm.

13. The method of claim 7, wherein the temperature at which stretching occurs is an the range of from 130-140° C.

* * * * *